US012691327B2

(12) United States Patent
Xing

(10) Patent No.: US 12,691,327 B2
(45) Date of Patent: Jul. 28, 2026

(54) ELLIPTICAL MACHINE

(71) Applicant: OMA FITNESS EQUIPMENT CO., LTD., Foshan City (CN)

(72) Inventor: Kaibin Xing, Foshan City (CN)

(73) Assignee: OMA FITNESS EQUIPMENT CO., LTD., Foshan City (CN)

( * ) Notice: Subject to any disclaimer, the term of this patent is extended or adjusted under 35 U.S.C. 154(b) by 127 days.

(21) Appl. No.: 18/603,724

(22) Filed: Mar. 13, 2024

(65) Prior Publication Data

US 2025/0235738 A1 Jul. 24, 2025

(30) Foreign Application Priority Data

Jan. 19, 2024 (CN) ..... 202410084611.2
Jan. 19, 2024 (CN) ..... 202420143533.4

(51) Int. Cl.
*A63B 22/06* (2006.01)
*A63B 22/00* (2006.01)

(52) U.S. Cl.
CPC ..... *A63B 22/0664* (2013.01); *A63B 22/001* (2013.01); *A63B 22/0015* (2013.01); *A63B 2022/0676* (2013.01)

(58) Field of Classification Search
CPC ..... A63B 22/0664; A63B 22/001; A63B 22/0023; A63B 22/0015; A63B 2022/0676; A63B 2022/002; A63B 2022/0682
See application file for complete search history.

(56) References Cited

U.S. PATENT DOCUMENTS

| | | | | |
|---|---|---|---|---|
| 5,919,118 | A * | 7/1999 | Stearns | A63B 22/0015 482/70 |
| 6,361,476 | B1 * | 3/2002 | Eschenbach | A63B 22/001 482/52 |
| 9,295,874 | B1 * | 3/2016 | Chen | A63B 22/001 |
| 9,468,795 | B2 * | 10/2016 | Arnold | A63B 21/154 |
| 9,707,439 | B2 * | 7/2017 | Lee | A63B 22/001 |
| 10,532,246 | B2 * | 1/2020 | Liao | A63B 21/225 |
| 10,561,891 | B2 * | 2/2020 | Luger | A63B 23/03583 |
| 11,504,575 | B2 * | 11/2022 | Chen | A63B 21/4034 |
| 2002/0019298 | A1 | 2/2002 | Eschenbach | |
| 2008/0125291 | A1 | 5/2008 | Watt | |
| 2008/0161163 | A1 | 7/2008 | Stewart | |

FOREIGN PATENT DOCUMENTS

EP 2147701 A1 1/2010

* cited by examiner

*Primary Examiner* — Megan Anderson
*Assistant Examiner* — Kathleen M Fisk
(74) *Attorney, Agent, or Firm* — Dickinson Wright PLLC; Andrew D. Dorisio

(57) ABSTRACT

An elliptical machine, which includes a frame body including a base and an upright column connected with the base; two movable mechanisms, each including a swing arm and a pedal rod, a first end of the swing arm being provided with a handle, a second end of the swing arm being rotatably connected to a first end of the pedal rod, a second end of the pedal rod being provided with a pedal; two adjusting mechanisms, each including a connecting rod and a driving device, the connecting rod being in swivel connection with a corresponding pedal rod, the driving device being drivingly connected with a first end of the connecting rod, for adjusting a position of a rotation center of the first end of the connecting rod; and a resistance mechanism, disposed on the frame body and movably connected with a second end of the connecting rod.

7 Claims, 4 Drawing Sheets

ELLIPTICAL MACHINE

CROSS-REFERENCES TO RELATED APPLICATION

The a application claims priority to Chinese patent application Nos. 202410084611.2 and 202420143533.4, filed before the Chinese Patent Office on Jan. 19, 2024, and entitled "Elliptical Machine", which are incorporated herein by reference in their entirety.

TECHNICAL FIELD

The present application relates to the technical field of fitness equipment and in particular, relates to an elliptical machine.

BACKGROUND

Elliptical machine is a kind of common fitness equipment, which simulates the natural motion trajectory of human body in running, skiing and other sports, so that users can do aerobic exercise with low impact, so as to lose weight, shape and enhance cardiopulmonary function and the like. Elliptical machine generally includes a frame body and two movable mechanisms. The movable mechanisms include handles and pedals. Users drive the movable mechanisms to do excises by holding the handles and stepping on the pedals.

SUMMARY

An elliptical machine is provided in embodiments of the present application.

The elliptical machine according to embodiments of the present application includes: a frame body including a base and an upright column connected with the base; two movable mechanisms, located at opposite sides of the upright column in a first direction, respectively, each movable mechanism including a swing arm, a pedal rod and a connecting rod, the swing arm being rotatably connected to the upright column, a first end of the swing arm being provided with a handle, a second end of the swing arm being rotatably connected to a first end of the pedal rod, a second end of the pedal rod being provided with a pedal, the connecting rod being rotatably connected with a corresponding pedal rod; two adjusting mechanisms, disposed corresponding to the two movable mechanisms, each adjusting mechanism being drivingly connected with a first end of the connecting rod of a corresponding movable mechanism, for adjusting a position of a rotation center of the first end of the connecting rod; and a resistance mechanism, disposed on the frame body and movably connected with a second end of the connecting rod, for applying reverse resistance to a motion of the second end of the connecting rod.

In an implementation, the frame body further includes two support columns connected with the base, which are disposed corresponding to the two adjustment mechanisms; each adjusting mechanism includes a telescopic unit, a rotating piece and an adjusting rod, the telescopic unit being installed on a corresponding support column, the rotating piece being rotatably installed on the corresponding support column, a first end of the rotating piece being rotatably connected to an output end of the telescopic unit, a first end of the adjusting rod being rotatably connected with a second end of the rotating piece, a second end of the adjusting rod being rotatably connected to a corresponding first end of the connecting rod.

In an implementation, the motion trajectory of the second end of the pedal rod has an included angle with respect to a horizontal direction, which is positively related to a height of the position of the rotation center of the first end of the connecting rod; wherein the height of position of the rotation center of the first end of the connecting rod is negatively related to a stroke of the telescopic unit.

In an implementation, the telescopic units of the two adjusting mechanisms work synchronously and have the same stroke.

In an implementation, the elliptical machine further includes: a control device configured to control, in response to an adjustment instruction, the telescopic units of the two adjustment mechanisms to work, so as to adjust the position of the rotation center of the first end of the connecting rod.

In an implementation, the frame body further includes two structural reinforcing columns, which are located at the opposite sides of the upright column, respectively, and each structural reinforcing column is connected between the upright column and the corresponding supporting column.

In an implementation, the adjusting rod, the pedal rod and the connecting rod are disposed at intervals in the first direction.

In an implementation, the resistance mechanism includes a metal disk, a magnetic piece group, a resistance transmission wheel and a crank, the metal disk and the resistance transmission wheel being rotatably installed on the frame body, magnetic field lines generated by the magnetic piece group are cut by the metal disk to apply resistance to the metal disk in a direction opposite to a rotation direction of the metal disk, the resistance transmission wheel being drivingly connected with the metal disk via a transmission belt, the crank being two cranks disposed on two sides of the resistance transmission wheel, respectively, and a first end of the crank being connected with a rotating shaft of the resistance transmission wheel, and a second end of the crank being rotatably connected with the second end of the connecting rod.

In an implementation, the position of the magnetic piece group relative to the metal disk is adjustable.

In an implementation, the frame body further includes an installation column, which is connected to the base and disposed at intervals with the upright column in a second direction perpendicular to the first direction, the resistance transmission wheel being rotatably installed on the installation column.

The above summary is for the purpose of illustration only and is not intended to put a limit in any way. In addition to the illustrative aspects, implementations and features described above, further aspects, implementations and features of the present application will be easily understood by referring to the drawings and the following detailed description.

BRIEF DESCRIPTION OF THE DRAWINGS

In the drawings, the same reference numerals indicate the same or similar components or elements throughout multiple drawings, unless otherwise specified. The drawings are not necessarily drawn to scale. It should be understood that these drawings depict only some implementations disclosed according to the present application and should not be considered as limiting the scope of the present application.

Figure 1:
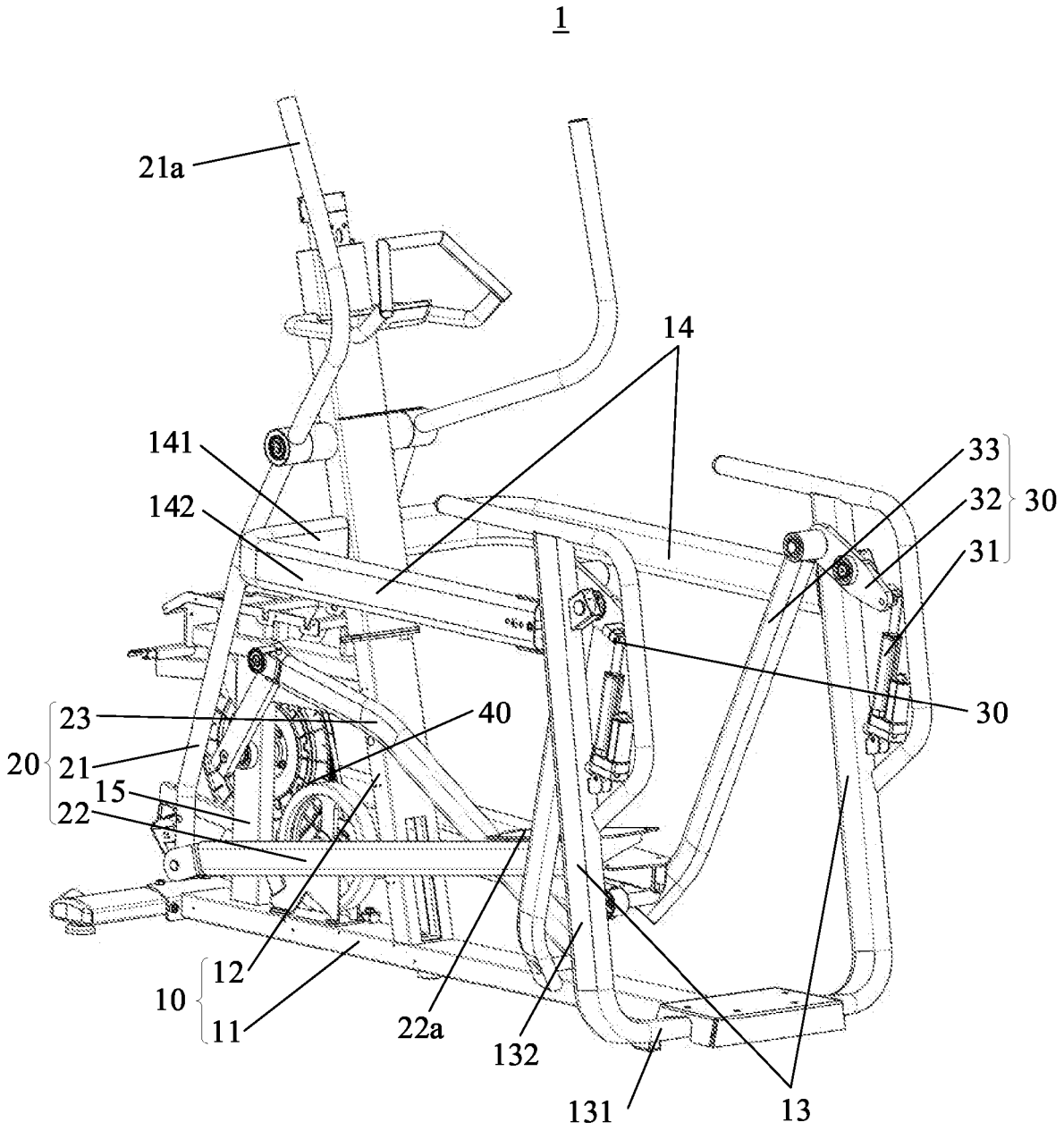
FIG. 1 shows a schematic structural diagram of an elliptical machine according to an embodiment of the present application under a certain visual angle.

NOTES OF REFERENCE NUMERALS elliptical machine 1;

frame body 10; base 11; upright column 12; support column 13; transversely extending segment 131; vertically extending segment 132; structural reinforcement column 14; first extending segment 141; second extending segment 142; installation column 15;

movable mechanism 20; swing arm 21; handle 21*a*; pedal rod 22; pedal 22*a*; connecting rod 23;

adjusting mechanism 30; telescopic unit 31; rotating piece 32; adjusting rod 33;

resistance mechanism 40; metal disk 41; resistance transmission wheel 42; crank 43.

DETAILED DESCRIPTION

In the following, only certain exemplary embodiments are simply described. As can be recognized by those skilled in the art, the described embodiments may be modified in various ways without departing from the spirit or scope of the present application. Accordingly, the drawings and description are to be regarded as illustrative in nature and not restrictive.

In the related technologies, the two pedals of an elliptical machine can move according to a preset motion trajectory, but because the motion trajectory of the pedals cannot be adjusted, it cannot meet users' needs for different ranges of motion or intensities of motion.

An elliptical machine is provided in embodiments of the present application to solve or alleviate one or more technical problems in the existing technology.

According to the elliptical machine of the embodiments of the present application, by disposing the adjusting mechanisms corresponding to the two movable mechanisms, the motion trajectory of the second end of the pedal rod, i.e., the pedal, can be adjusted, so that users' exercise requirements for different ranges of motion and intensities of motion can be met, and users' use experience is improved.

An elliptical machine 1 according to an embodiment of the present application will be described below with reference to FIGS. 1 to 6.

FIG. 1 shows a structural schematic diagram of an elliptical machine 1 according to an embodiment of the present application in a certain visual angle. As shown in FIG. 1, the elliptical machine 1 of the embodiment of the present application includes a frame body 10, two movable mechanisms 20, two adjusting mechanisms 30 and a resistance mechanism 40. Specifically, the frame body 10 includes a base 11 and an upright column 12 connected to the base 11. The two movable mechanisms 20 are located at the opposite sides of the upright column 12 in a first direction, respectively. The movable mechanism 20 includes a swing arm 21, a pedal rod 22 and a connecting rod 23. The swing arm 21 is rotatably connected to the upright column 12. The first end of the swing arm 21 is provided with a handle 21*a*. The second end of the swing arm 21 is rotatably connected to the first end of the pedal rod 22. The second end of the pedal rod 22 is provided with a pedal 22*a*. The connecting rod 23 is rotatably connected with the corresponding pedal rod 22. The two adjusting mechanisms 30 are disposed corresponding to the two movable mechanisms 20, the adjusting mechanism 30 being drivingly connected with the first end of the connecting rod 23 of the corresponding movable mechanism 20, for adjusting the position of the rotation center of the first end of the connecting rod 23. The resistance mechanism 40 is disposed on the frame body 10 and movably connected with the second end of the connecting rod 23, for applying reverse resistance to the motion of the second end of the connecting rod 23.

In the embodiment of the present application, the first direction and the second direction are any two directions that are parallel to the horizontal plane and perpendicular to each other. In the following description of the specification of the present application, the first direction is the left-right direction of the frame body 10, and the second direction is the front-back direction of the frame body 10.

Illustratively, the two movable mechanisms 20 are located at the opposite sides of the upright column 12 in the first direction, and in either movable mechanism 20, the position where the swing arm 21 is rotatably connected with the upright column 12 is located between the first end and the second end of the swing arm 21, so that the first end and the second end of the swing arm 21 can be located at the opposite sides of the upright column 12 in the second direction. Among others, the first end of the swing arm 21 is located at the rear side of the upright column 12, the second end is located at the front side of the upright column 12, and the first end of the swing arm 21 is located at the upper side of the second end. The first end and the second end of the pedal rod 22 are located at the opposite sides of the upright column 12 in the second direction, respectively. Among others, the first end of the pedal rod 22 is located at the front side of the upright column 12, and the second end thereof is located at the rear side of the upright column 12. The first end of the pedal rod 22 is rotatably connected with the second end of the swing arm 21. The position where the pedal rod 22 is rotatably connected with the connecting rod 23 is located between the first end and the second end of the pedal rod 22, and the position where the connecting rod 23 is rotatably connected with the pedal rod 22 is located between the first end and the second end of the connecting rod 23. The first end and the second end of the connecting rod 23 are located at the opposite sides of the upright column 12 in the second direction, respectively. Among others, the first end of the connecting rod 23 is located at the front side of the upright column 12 and the second end thereof is located at the rear side of the upright column 12. The first end of the connecting rod 23 is movably connected with the adjusting mechanism 30, and the second end of the connecting rod 23 is movably connected with the resistance mechanism 40.

In the embodiment of the present application, any connection modes between the swing arm 21 and the upright column 12, between the pedal rod 22 and the swing arm 21, and between the connecting rod 23 and the pedal rod 22 may be adopted, as long as the relative swivel between them can be achieved. For example, other connection modes such as shaft hole fitting can be adopted, which is not specifically limited in the embodiment of the present application. The handle 21*a* disposed at the first end of the swing arm 21 is used for holding by the user's hand, and the pedal 22*a* disposed at the second end of the pedal rod 22 is used for stepping on by the user's foot. When a user uses the elliptical machine 1 of the embodiment of the present application, he/she may stand on two pedals 22*a* with both feet and hold two handles 21*a* with both hands. By applying force to the pedals 22*a* of the two movable mechanisms 20 with both feet respectively and by applying force to the handles 21*a* of the two movable mechanisms 20 with both hands, respectively, the swing arms 21 and the pedal rods 22 of the two movable mechanisms 20 and the connecting rods 23 of the adjusting mechanism 30 can be driven to form linkage, and the pedals 22*a* of the two movable mechanisms 20 can move along an elliptical or nearly elliptical trajectory, so that the user can simulate running, skiing and other forms of excises with the aid of the elliptical machine 1. In addition, the shapes of the swing arm 21, the pedal rod 22 and the connecting rod 23 may be arbitrarily set by those skilled in the art according to the actual situation and are not specifically limited in the embodiment of the present application.

For example, the first end and the second end of the connecting rod 23 may make a circular motion with respect to the frame body 10, respectively. Specifically, the first end of the connecting rod 23 may be rotatably connected with the frame body 10 through the adjusting rod 33, so that the first end of the connecting rod 23 makes a circular motion relative to the rotating shaft of the adjusting rod 33; the second end of the connecting rod 23 may be rotatably connected with the resistance transmission wheel 42 of the resistance mechanism 40 through the crank 43, so that the second end of the connecting rod 23 makes a circular motion relative to the rotating shaft of the resistance transmission wheel 42. The first end of the pedal rod 22 is rotatably connected with the second end of the swing arm 21, and the first end of the pedal rod 22 makes a circular motion relative to the frame body 10 along with the second end of the swing arm 21. The pedal rod 22 is linked by the connecting rod 23, and the second end of the pedal rod 22 may move along a generally elliptical trajectory.

Among others, the rotation center of the first end of the connecting rod 23 may be the rotation center of the connecting rod 23 relative to the adjusting mechanism 30. In the embodiment of the present application, the first end of the connecting rod 23 may be rotatably connected with the second end of the adjusting rod 33 of the adjusting mechanism 30, and the first end of the adjusting rod 33 is rotatably connected with the frame body 10, so that the position of the rotation center of the first end of the connecting rod 23 may be regarded as the position of the first end of the adjusting rod 33.

It should be noted that the motion trajectory of the second end of the pedal rod 22 is associated with the motion trajectory of the second end of the connecting rod 23. By adjusting the position of the second end of the connecting rod 23, the adjusting mechanism 30 may change the motion trajectory of the second end of the connecting rod 23, and further adjust the motion trajectory of the second end of the pedal rod 22, i.e., the pedal 22*a*. For example, the motion trajectory of the pedal 22*a* may be generally elliptical, and the long axis of the ellipse has an included angle with the horizontal plane. The position of the second end of the connecting rod 23 is adjusted through the adjusting mechanism 30 to change the included angle between the long axis of the motion trajectory of the pedal 22*a* and the horizontal plane. Among others, when the included angle between the long axis and the horizontal plane is relatively small, the motion trajectory of the pedal 22*a* approaches the horizontal state, so that the user can simulate the excise mode of walking on the flat ground when using it; when the included angle between the long axis and the horizontal plane is relatively large, the motion trajectory of the pedal 22*a* is inclined, so that the user can simulate the excise mode of climbing when using it.

To sum up, according to the elliptical machine 1 of the embodiments of the present application, by disposing the adjusting mechanisms 30 corresponding to the two movable mechanisms 20, the motion trajectory of the second end of the pedal rod 22, i.e., the pedal 22*a*, can be adjusted, thereby meeting users' exercise needs for different ranges of motion and intensities of motion and improving users' use experience.

In an implementation, the frame body 10 further includes two support columns 13 connected with the base 11, which are disposed corresponding to the two adjustment mechanisms 30; the adjusting mechanism 30 includes a telescopic unit 31, a rotating piece 32 and an adjusting rod 33, the telescopic unit 31 being installed on the corresponding support column 13, the rotating piece 32 being rotatably installed on the corresponding support column 13, the first end of the rotating piece 32 being rotatably connected to an output end of the telescopic unit 31, the first end of the adjusting rod 33 being rotatably connected with the second end of the rotating piece 32, the second end of the adjusting rod 33 being rotatably connected to the corresponding first end of the connecting rod 23.

Illustratively, the two supporting columns 13 are disposed at the opposite sides of the base 11 in the first direction, respectively, and are respectively connected to the ends of the base 11 and disposed at intervals with the upright columns 12. The support column 13 may specifically include a transverse extension segment 131 and a vertical extension segment 132, wherein the transverse extension segment 131 extends in the horizontal direction and is connected with the end of the base 11, and the vertical extension segment 132 extends in the vertical direction or in a direction at a small angle with the vertical direction and is connected with the end of the transverse extension segment 131. The two adjusting mechanisms 30 are installed on the support columns 13 on the corresponding side, respectively.

In some specific examples, the telescopic unit 31 may adopt a lifting motor, an electric telescopic rod or a hydraulic cylinder, etc., which is not specifically limited in the embodiment of the present application. The rotating piece 32 is disposed adjacent to the upper end of the support column 13 and rotatably connected with the support column 13, and the swivel connection between the rotating piece 32 and the support column 13 is located between the first end and the second end of the rotating piece 32. The rotating piece 32 is located on the upper side of the telescopic unit 31, and the first end of the rotating piece 32 is rotatably connected with the output end of the telescopic unit 31. The second end of the rotating member 32 is rotatably connected with the first end of the adjusting rod 33, and the second end of the adjusting rod 33 is rotatably connected with the first end of the connecting rod 23.

It can be understood that when the output end of the telescopic unit 31 is telescopic, the adjusting rod 33 may be driven by the rotating member 32 to move, so that the position of the rotation center of the first end of the connecting rod 23 rotatably connected with the adjusting rod 33 changes, and then the position of the second end of the pedal rod 22 rotatably connected with the connecting rod 23 changes, so as to achieve the purpose of adjusting the motion trajectory of the pedal 22*a*.

In an implementation, the motion trajectory of the second end of the pedal rod 22 has an included angle with respect to the horizontal direction, which is positively related to the height of the position of the rotation center of the first end of the connecting rod 23; wherein the height of the position of the rotation center of the first end of the connecting rod 23 is negatively related to the stroke of the telescopic unit 31.

In the embodiment of the present application, the motion trajectory of the second end of the pedal rod 22 may be elliptical or nearly elliptical in shape, and the included angle of the motion trajectory of the second end of the pedal rod 22 with respect to the horizontal direction may be the included angle between the long axis of the ellipse and the horizontal plane.

It should be noted that the included angle of the motion trajectory of the second end of the pedal rod 22 with respect to the horizontal direction is positively related to the height of the position of the rotation center of the first end of the connecting rod 23, which means that the greater the height of the position of the rotation center of the first end of the connecting rod 23, the greater the included angle of the movement motion trajectory of the second end of the pedal rod 22 with respect to the horizontal direction. On the contrary, the smaller the height of the position of the rotation center of the first end of the connecting rod 23, the smaller the included angle of the motion trajectory of the second end of the pedal rod 22 with respect to the horizontal direction. The height of the position of the rotation center of the first end of the connecting rod 23 is negatively related to the stroke of the telescopic unit 31, which means that the greater the stroke of the telescopic unit 31, the smaller the height of the position of the rotation center of the first end of the connecting rod 23; the smaller the stroke of the telescopic unit 31, the higher the height of the position of the rotation center of the first end of the connecting rod 23.

Figure 2:
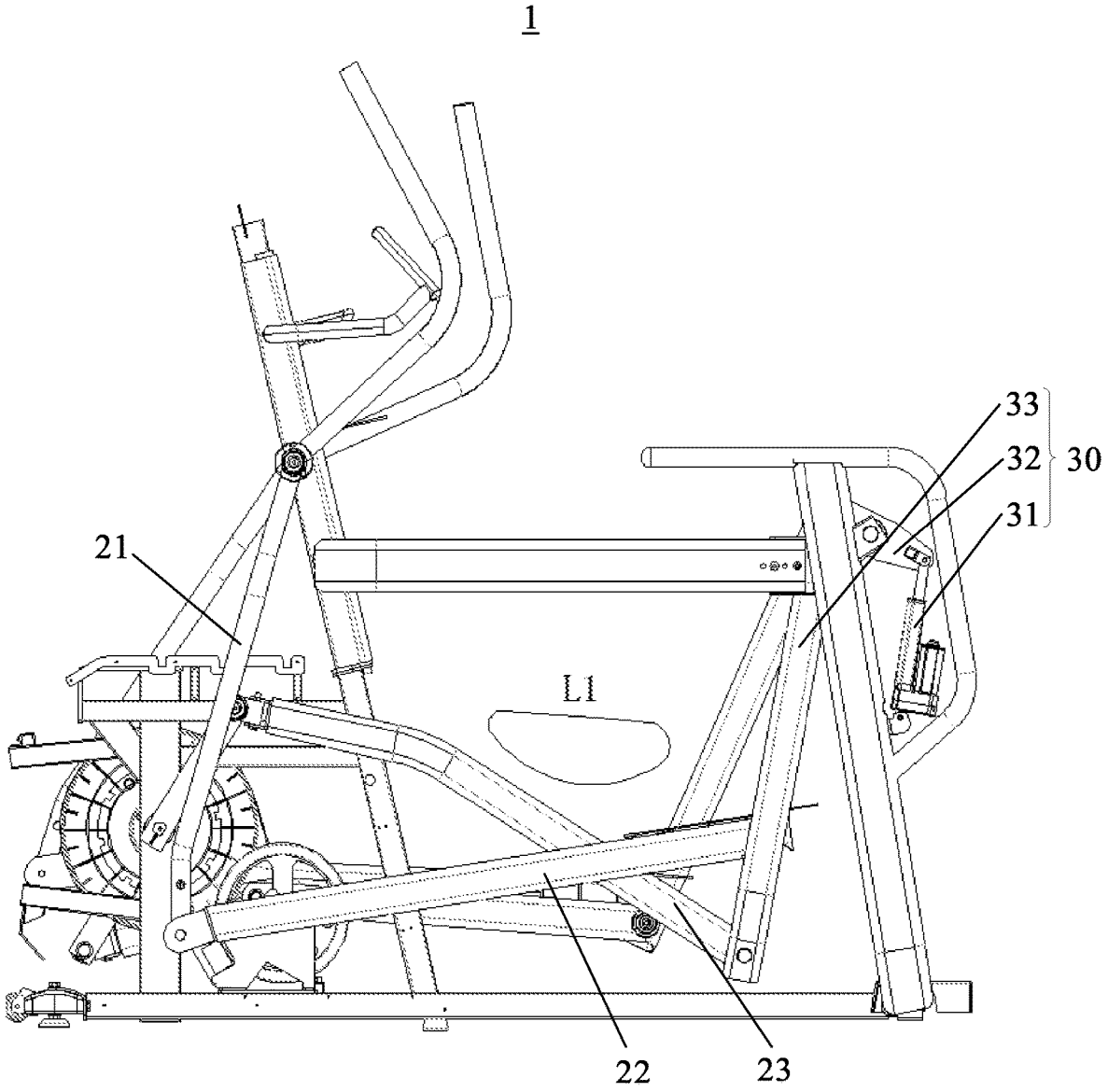
FIG. 2 shows a side view of an elliptical machine according to an embodiment of the present application when a stroke of a telescopic unit is maximum.

FIG. 2 shows a side view of an elliptical machine 1 according to an embodiment of the present application when the stroke of the telescopic unit 31 is maximum. As shown in FIG. 2, in some specific examples, when the stroke of the telescopic unit 31 is maximum, the first end of the rotating piece 32 rotates to the highest position and the second end of the rotating piece 32 rotates to the lowest position. Accordingly, the first end of the adjusting rod 33 rotatably connected with the second end of the rotating member 32 is adjusted to the lowest position. Among others, the position of the rotation center of the adjusting rod 33 is the same as the position of the second end of the rotating member 32. At this time, the position of the rotation center of the adjusting rod 33 is the lowest point. Based on this, the included angle of the long axis of the motion trajectory L1 of the second end of the pedal rod 22, i.e., the pedal 22*a* with respect to the horizontal plane is the smallest, that is, the motion trajectory of the pedal 22*a* is the gentlest.

Figure 3:
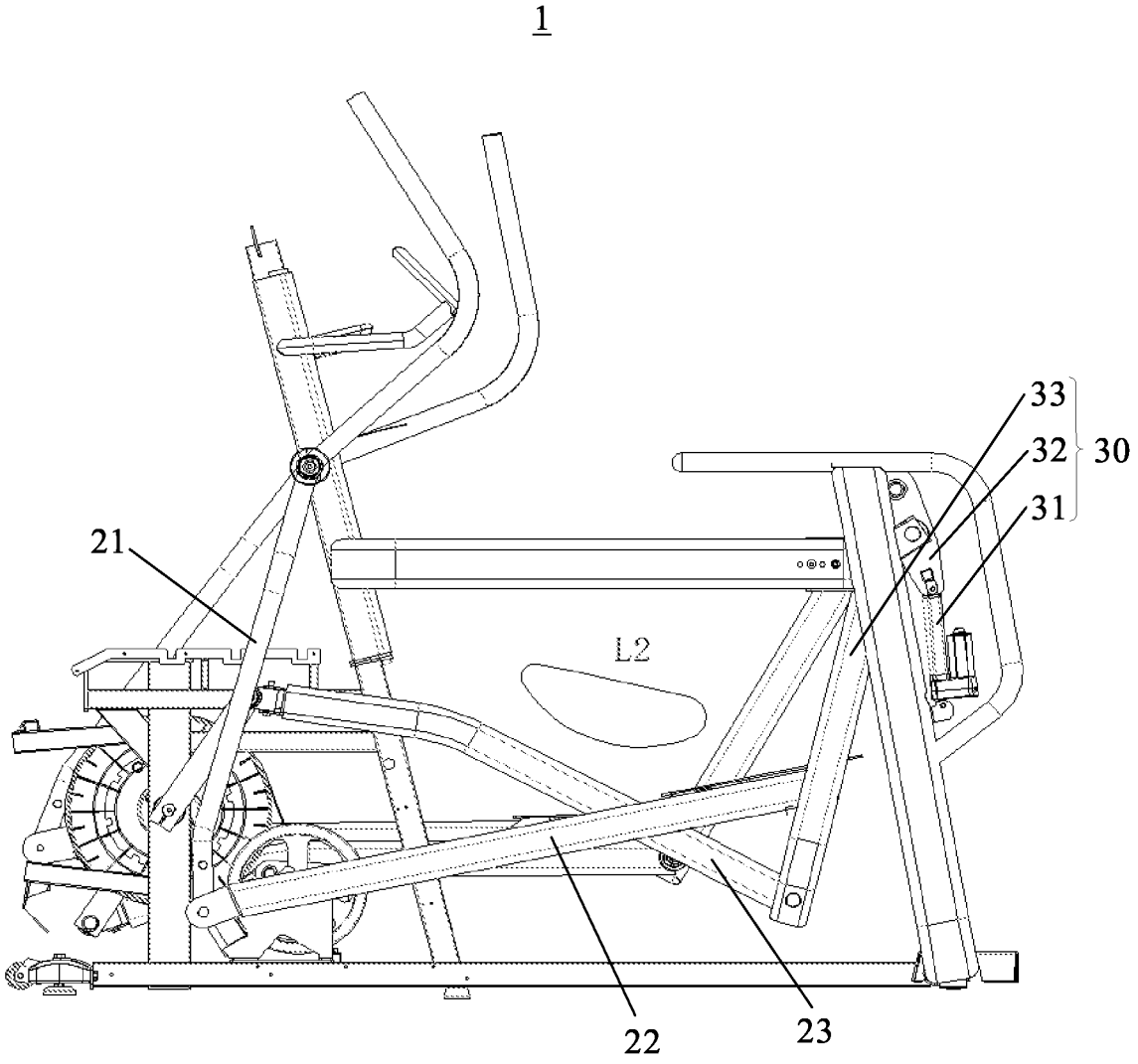
FIG. 3 shows a side view of an elliptical machine according to an embodiment of the present application when a stroke of a telescopic unit is minimum.

FIG. 3 shows a side view of an elliptical machine 1 according to an embodiment of the present application when the stroke of the telescopic unit 31 is minimum. As shown in FIG. 3, in some specific examples, when the stroke of the telescopic unit 31 is minimum, the first end of the rotating piece 32 rotates to the lowest position and the second end of the rotating piece 32 rotates to the highest position. Accordingly, the first end of the adjusting rod 33 rotatably connected with the second end of the rotating member 32 is adjusted to the highest position. Among others, the position of the rotation center of the adjusting rod 33 is the same as the position of the second end of the rotating member 32. At this time, the position of the rotation center of the adjusting rod 33 is the highest point. Based on this, the included angle of the long axis of the motion trajectory L2 of the second end of the pedal rod 22, i.e., the pedal 22*a* with respect to the horizontal plane is the largest, that is, the motion trajectory of the pedal 22*a* is the steepest.

In an implementation, the telescopic units 31 of the two adjusting mechanisms 30 work synchronously and have the same stroke.

It can be understood that the two movable mechanisms 20 are located at the opposite sides of the upright column 12. In order to ensure that the motion trajectories of the user's feet are roughly the same during use, the motion trajectory of the second ends of the pedal rods 22 of the two movable mechanisms 20 need to be kept the same, so the positions of the rotation centers of the first ends of the connecting rods 23 connected to the two pedal rods 22 need to be the same. Therefore, during the adjustment of the two adjusting mechanisms 30, the two telescopic units 31 need to work synchronously, and the strokes of the two telescopic units 31 need to be consistent as well.

In an implementation, the elliptical machine 1 further includes: a control device configured to control the telescopic units 31 of the two adjustment mechanisms 30 to work in response to an adjustment instruction to adjust the position of the rotation center of the first end of the connecting rod 23.

Illustratively, the elliptical machine 1 further includes an instruction input device, which is disposed on the top of the upright column 12 or at the first end of the swing arm 21. The instruction input device is used for the user to input an adjustment instruction and transmit the adjustment instruction to the control device. The adjustment instruction may include an ascending instruction and a descending instruction, wherein the ascending instruction is used to request to increase the included angle between the motion trajectory of the pedal 22*a* and the horizontal direction, so as to increase the exercise intensity; the descending instruction is used to request to reduce the included angle between the motion trajectory of the pedal 22*a* and the horizontal direction, so as to reduce the exercise intensity. In response to the adjustment instruction, the control device controls the extension end of the telescopic unit 31 to extend or retract, thereby adjusting the height of the position of the rotation center of the first end of the connecting rod 23, and further adjusting the motion trajectory of the pedal 22*a*.

In an implementation, as shown in FIG. 1, the frame body 10 further includes two structural reinforcing columns 14, which are located at the opposite sides of the upright column 12, respectively, and each of the structural reinforcing columns 14 is connected between the upright column 12 and the corresponding supporting column 13, respectively.

Illustratively, the two structural reinforcement columns 14 are oppositely disposed in the first direction. The structural reinforcement column 14 may include a first extension segment 141 and a second extension segment 142 which are connected. The first extension segment 141 extends along the first direction, and the end of the first extension segment 141 is connected with the upright column 12; the second extension segment 142 extends in the second direction, and the end of the second extension segment 142 is connected with the support column 13. Among others, the first direction may be the width direction of the elliptical machine 1, and the second direction may be the length direction of the elliptical machine 1.

With this arrangement, on the one hand, the overall structural strength of the elliptical machine 1 can be improved, and on the other hand, the two structural reinforcement columns 14 may play a protective role for users, so as to prevent users from tilting sideways during use.

In an implementation, the adjusting rod 33, the pedal rod 22 and the connecting rod 23 are disposed at intervals in the first direction.

Illustratively, in either side of the upright column 12 in the first direction, the adjusting rod 33, the pedal rod 22 and the connecting rod 23 are disposed at intervals in the first direction, wherein the pedal rod 22 is located on the side of the adjusting rod 33 adjacent to the upright column 12, and the connecting rod 23 is located on the side of the pedal rod 22 adjacent to the upright column 12, that is, the pedal rod 22 is located between the adjusting rod 33 and the pedal rod 22 in the first direction.

Through the above-mentioned implementation, when the user uses the elliptical machine 1, the interference between the adjustment, the pedal rod 22 and the connecting rod 23 during linkage can be avoided.

Figure 4:
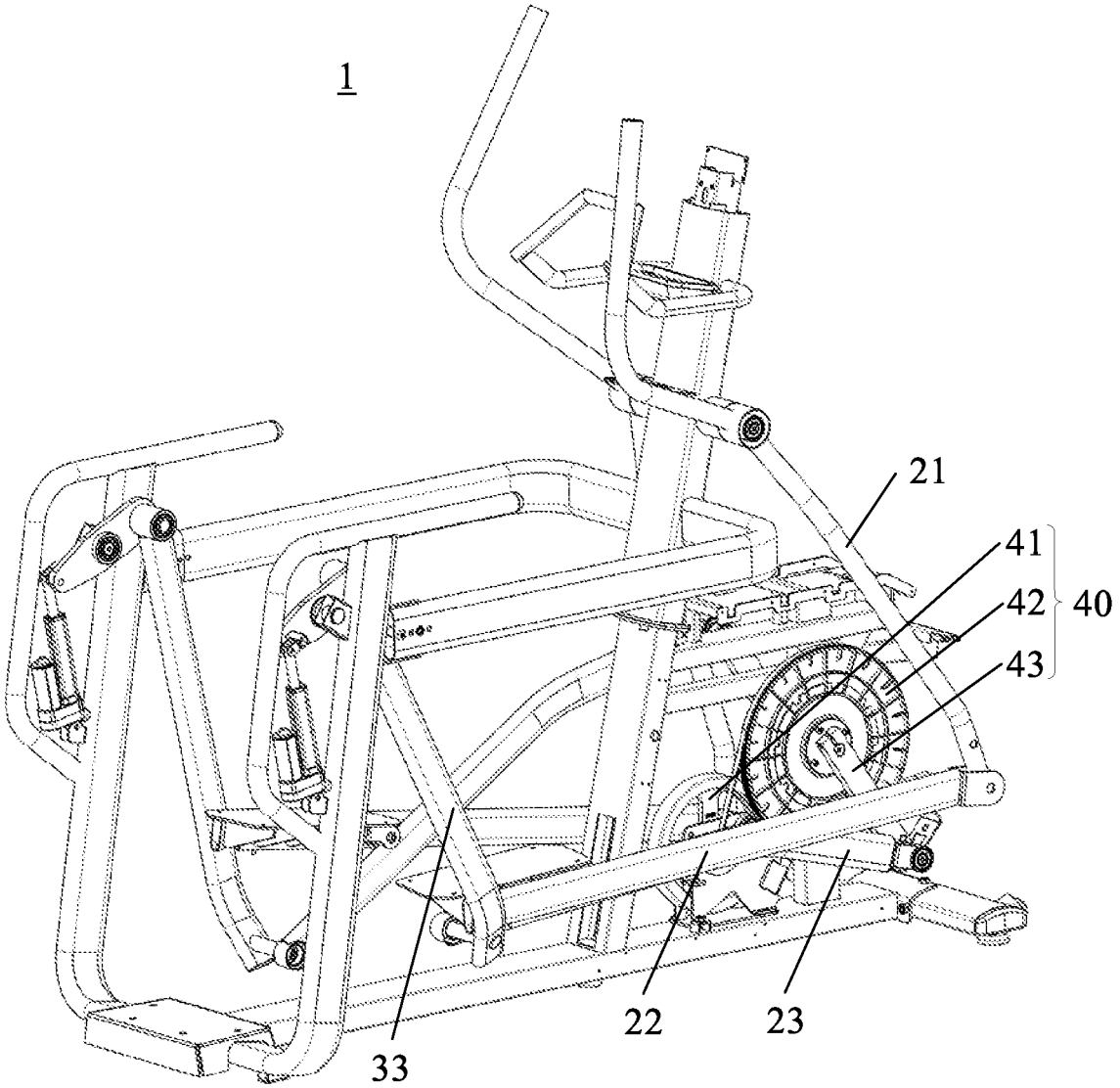
FIG. 4 shows a schematic structural diagram of an elliptical machine according to an embodiment of the present application under another visual angle.

FIG. 4 shows a schematic structural diagram of an elliptical machine 1 according to an embodiment of the present application under another visual angle. As shown in FIG. 4, in an implementation, the resistance mechanism 40 includes a metal disk 41, a magnetic piece group, a resistance transmission wheel 42 and a crank 43, the metal disk 41 and the resistance transmission wheel 42 being rotatably installed on the frame body 10, magnetic field lines generated by the magnetic piece group are cut by the metal disk 41 to apply resistance to the metal disk 41 in a direction opposite to the rotation direction of the metal disk 41, the resistance transmission wheel 42 being drivingly connected with the metal disk 41 via a transmission belt, there being two cranks 43, which are disposed on two sides of the resistance transmission wheel 42, respectively, and the first end of the crank 43 being connected with the rotating shaft of the resistance transmission wheel 42, and the second end of the crank 43 being rotatably connected with the second end of the connecting rod 23. Among others, the metal disk 41 may be made of aluminum.

It can be understood that the first end of the crank 43 is drivingly connected with the rotating shaft of the resistance transmission wheel 42, and the second end of the crank 43 is rotatably connected with the second end of the connecting rod 23. Therefore, when the pedal rod 22 drives the connecting rod 23 to move, the connecting rod 23 drives the resistance transmission wheel 42 to rotate through the crank 43, and the resistance transmission wheel 42 drives the metal disk 41 to rotate through the belt. In the process of rotation, the metal disk 41 can cut the magnetic field lines of the magnetic field generated by the magnetic piece group, thus generating on the metal disk 41 a magnetic force opposite to its rotation direction. Based on this, the resistance mechanism 40 can generate resistance opposite to the movement direction of the connecting rod 23, and this resistance is transmitted to the pedal rod 22 through the connecting rod 23, so that the acting force is fed back to the user's foot.

Alternatively, the position of the magnetic piece group relative to the metal disk 41 is adjustable.

Illustratively, the magnetic piece group includes a plurality of magnetic pieces disposed in groups, which may be symmetrically distributed on both sides of the metal disk 41. The magnetic piece group is disposed in the fixed part, and the fixed part is rotatably connected to the base 11. By rotating the fixing part relative to the base 11, the position of the magnetic piece group relative to the metal disk 41 is adjusted, and then the magnitude of the resistance generated by the resistance mechanism 40 can be adjusted.

Alternatively, the frame body 10 further includes an installation column 15, which is connected to the base 11 and disposed at intervals with the upright column 12 in a second direction being perpendicular to the first direction, the resistance transmission wheel 42 being rotatably installed on the installation column 15.

Other components of the elliptical machine 1 according to the above-mentioned embodiment of the present application may be adopted in various technical solutions known by those skilled in the art now and in the future, and will not be described in detail here.

The azimuth or positional relationships indicated by the terms "center", "longitudinal", "horizontal", "length", "width", "thickness", "upper", "lower", "front", "back", "left", "right", "vertical", "horizontal", "top", "bottom", "inner", "outer", "clockwise", "counterclockwise", "axial", "radial", "circumferential", etc. are based on the azimuth or positional relationship shown in the drawings. These terms are intended only to facilitate the description and simplified description of the present application, and are not intended to indicate or suggest that the device or element referred to must have a specific orientation, be constructed and operated in a specific position, and therefore cannot be construed as a restriction on the present application In addition, the terms "first" and "second" are only used for descriptive purposes and cannot be understood as indicating or implying relative importance or implicitly indicating the number of indicated technical features. Therefore, the features defined as "first" and "second" may include one or more of these features explicitly or implicitly. In the description of the present application, "a plurality" means two or more, unless otherwise specifically defined explicitly.

In the present application, unless otherwise specified and defined, the terms "install", "connect with", "connect" and "fix/secure" should be broadly understood, for example, the connection may be fixed, detachable or integrated; the connection may be mechanical, electrical or communicative; the connection may be direct, may be indirect via an intermediary, or may be the internal communication of two elements or the interaction relationship between two elements. For those skilled in the art, the specific meanings of the above terms in the present application may be understood according to the specific circumstances.

In the present application, unless otherwise specified and defined, the first feature "on" or "under" the second feature may include direct contact between the first and second features or may include that the first and second features are not in direct contact but are in contact through another feature between them. Moreover, the words "on", "above" and "over" of the first feature include that the first feature is directly above and obliquely above the second feature, or only indicate that the horizontal height of the first feature is higher than that of the second feature. The words "under", "below" and "underneath" of the first feature include that the first feature is directly below and obliquely below the second feature, or only indicate that the horizontal height of the first feature is smaller than that of the second feature.

The above disclosure provides many different embodiments or examples to implement different structures of the present application. In order to simplify the disclosure of the present application, the components and arrangements of specific examples are described above. Of course, they are only examples and are not intended to limit the present application. Furthermore, the present application may repeat reference numerals and/or reference letters in different examples, and this repetition is for the purpose of simplicity and clarity and does not in itself indicate the relationship between the various embodiments and/or arrangements discussed.

The above description is only the specific implementation of the present application, but the protection scope of the present application is not limited thereto. Any person familiar with this technical field may easily conceive of various changes or substitutions within the technical scope disclosed in the present application, all of which should be included in the protection scope of the present application. Therefore, the protection scope of the present application should be based on the protection scope of the claims.

What is claimed is:

1. An elliptical machine, comprising:

a frame body comprising a base and an upright column connected with the base;

two movable mechanisms, located at opposite sides of the upright column in a first direction, respectively, each movable mechanism comprising a swing arm, a pedal rod and a connecting rod, the swing arm being rotatably connected to the upright column, a first end of the swing arm being provided with a handle, a second end of the swing arm being rotatably connected to a first end of the pedal rod, a second end of the pedal rod being provided with a pedal, the connecting rod being rotatably connected with the pedal rod;

two adjusting mechanisms, disposed corresponding to the two movable mechanisms, each adjusting mechanism being drivingly connected with a first end of the connecting rod of a corresponding one of the two movable mechanism, for adjusting a position of a rotation center of the first end of the connecting rod;

a resistance mechanism, disposed on the frame body and movably connected with a second end of the connecting rod of each one of the two movable mechanisms, for applying reverse resistance to a motion of the second end of the connecting rod of each one of the two movable mechanisms; and wherein the frame body further comprises two support columns connected with the base, which are disposed corresponding to the two adjusting mechanisms; each adjusting mechanism comprises a telescopic unit, a rotating piece and an adjusting rod, the telescopic unit being installed on a corresponding one of the two support columns, the rotating piece being rotatably installed on the corresponding one of the two support columns, a first end of the rotating piece being rotatably connected to an output end of the telescopic unit, a first end of the adjusting rod being rotatably connected with a second end of the rotating piece, a second end of the adjusting rod being rotatably connected to the first end of the connecting rod of the corresponding one of the two movable mechanisms;

wherein a motion trajectory of the second end of the pedal rod of each one of the two movable mechanisms has an included angle with respect to a horizontal direction, which is positively related to a height of the position of the rotation center of the first end of the connecting rod of the corresponding one of the two movable mechanisms; wherein the height of the position of the rotation center of the first end of the connecting rod is negatively related to a stroke of the telescopic unit of a corresponding one of the two adjusting mechanisms.

2. The elliptical machine according to claim 1, wherein the telescopic units of the two adjusting mechanisms work synchronously and have the same stroke.

3. The elliptical machine according to claim 2, further comprising:

a control device configured to control, in response to an adjustment instruction, the telescopic units of the two adjusting mechanisms to work, so as to adjust the position of the rotation center of the first end of the connecting rods of the two movable mechanisms.

4. The elliptical machine according to claim 1, wherein the resistance mechanism comprises a metal disk, a resistance transmission wheel and a crank, the metal disk and the resistance transmission wheel being rotatably installed on the frame body, magnetic field lines generated by the resistance mechanism are cut by the metal disk to apply resistance to the metal disk in a direction opposite to a rotation direction of the metal disk, the resistance transmission wheel being drivingly connected with the metal disk via a transmission belt, the crank being two cranks disposed on two sides of the resistance transmission wheel, respectively, and a first end of each crank being connected with a rotating shaft of the resistance transmission wheel, and a second end of each crank being rotatably connected with the second end of the connecting rod of corresponding one of the two movable mechanisms.

5. The elliptical machine according to claim 4, wherein the frame body further comprises an installation column, which is connected to the base and disposed at intervals with the upright column in a second direction perpendicular to the first direction, the resistance transmission wheel being rotatably installed on the installation column.

6. The elliptical machine according to claim 1, wherein the frame body further comprises two structural reinforcing columns, which are located at the opposite sides of the upright column, respectively, and each structural reinforcing column is connected between the upright column and a corresponding one of the two supporting columns.

7. The elliptical machine according to claim 1, wherein for each of the two adjusting mechanisms and the corresponding one of the two movable mechanism, the adjusting rod, the pedal rod and the connecting rod are disposed at intervals in the first direction.

* * * * *